US007175468B1

(12) United States Patent
Chang

(10) Patent No.: US 7,175,468 B1
(45) Date of Patent: Feb. 13, 2007

(54) PLUG FOR THE TRANSMISSION OF HIGH FREQUENCY/TELECOMMUNICATION SIGNALS

(75) Inventor: Ray Chang, Hsichih (TW)

(73) Assignee: Telebox Industries Corp., Taipei Hsien (TW)

( * ) Notice: Subject to any disclaimer, the term of this patent is extended or adjusted under 35 U.S.C. 154(b) by 0 days.

(21) Appl. No.: 11/447,051

(22) Filed: Jun. 6, 2006

(51) Int. Cl.
*H01R 4/24* (2006.01)

(52) U.S. Cl. ..... 439/418; 439/676; 439/680

(58) Field of Classification Search ..... 439/676, 439/418, 445, 694, 941, 678, 701, 465, 942, 439/460, 404, 344, 638, 660, 354, 467, 455, 439/692, 894, 680
See application file for complete search history.

(56) References Cited

U.S. PATENT DOCUMENTS 6,238,235 B1 * 5/2001 Shavit et al. ..... 439/418
6,783,402 B2 * 8/2004 Chen ..... 439/676
6,811,445 B2 * 11/2004 Caveney et al. ..... 439/676
6,846,197 B2 * 1/2005 Hirokawa et al. ..... 439/418
7,018,241 B2 * 3/2006 Caveney et al. ..... 439/676
2003/0224666 A1 * 12/2003 Yuan-Huei ..... 439/676
2005/0106929 A1 * 5/2005 Meckley et al. ..... 439/418

* cited by examiner

*Primary Examiner*—Truc T. Nguyen
*Assistant Examiner*—Edwin A. Leon
(74) *Attorney, Agent, or Firm*—Troxell Law Office, PLLC

(57) ABSTRACT

A plug fastened to a cable and electrically connected to the conductors of the 4 twisted pairs of a cable for transmission of high frequency/telecommunication signals is disclosed to include a housing, which has a holding down block stamped to hold down the cable, a load bar, which is inserted into the housing with the cable and has wire slots for receiving the conductors of the cable respectively and wire grooves for guiding the conductors of the cable into the wire slots, and a cable organizer, which has front guide flanges respectively engaged into rear guide grooves of the load bar, and four wire grooves formed in four sides and separated from one another by a partition wall for dividing the four twisted pairs of the cable to prevent crosstalk noises.

3 Claims, 10 Drawing Sheets

PLUG FOR THE TRANSMISSION OF HIGH FREQUENCY/TELECOMMUNICATION SIGNALS

BACKGROUND AND SUMMARY OF THE INVENTION

The present invention relates to electric plugs and more particularly, to a plug for the transmission of high frequency/telecommunication signals, which uses a holding down block to hold down the cable and a cable organizer to divide the twisted pairs of the cable, reducing crosstalk noises.

U.S. Pat. No. 7,018,241B2 discloses a modular cable termination plug having a conductor divider having an entrant barb and a plurality of divider channels, a load bar having a plurality of through holes and a plurality of slots, a plurality of contact terminals, a housing, a strain relief collar, and a strain relief boot. The conductor divider and the load bar allow insertion and alignment of the conductors of the cable and reduce crosstalk noises. However, this plug design uses a great number of component parts that require much labor and time to assemble. Further, the molding or manufacturing cost of every component part of this design of plug is high. A minor error in any step during the assembly process of the plug results in a defective product.

US 2003/0224666A1 teaches the use of a distributor to divide the 8 conductors of the cable. However, because the distributor is directly fastened to the housing, it is difficult to align the conductors, and an error may occur easily when inserting the metal contacts into the plug to touch the conductors.

U.S. Pat. No. 6,238,235B1 teaches the use of a cable organizer to reduce crosstalk noises and the use of a load bar to align the conductors. However, this design does not allow quickly alignment of the 8 conductors of the cable in the load bar. Further, two bracket means must be used so that the load bar and the cable organizer can be inserted into the housing. After insertion of the load bar with the cable organizer into the housing, a position error of the load bar in longitudinal direction relative to the metal contact insertion position at the top side of the housing may occur easily, thereby resulting in a contact error or defective product.

US 2005/0106929A1 discloses a wire aligner that divides the 8 conductors of the cable and keeps the conductor aligned. However, because the conductors are curved when separated, i.e., the front ends of the conductors of the cable are not well organized. After installation of the wire aligner in the housing, the metal contacts may be unable to touch the conductors accurately, thereby resulting in a defective product. Further, the wire aligner may vibrate after assembled with the strain relief member.

FIG. 1 is a schematic view, partially in section, of a modular plug 6 according to the prior art before stamp of the holding down block 612 of the housing 61. FIG. 2 is a cross sectional view of FIG. 1. As illustrated, the pitch among the twisted pairs 74,75; 73,76; 71,72; 77,78 does not change. However, when the holding down block 612 of the housing 61 is stamped against the cable 7, as shown in FIGS. 3 and 4, the bottom side 6121 of the holding down block 612 is pressed on the cable 7, causing deformation of the cable 7. At this time, the pitch among the twisted pairs 74,75; 73,76; 71,72; 77,78 is changed, affecting normal signal transmission.

The present invention has been accomplished under the circumstances in view. According to one aspect of the present invention, the plug comprises a housing, a cable organizer mounted in the housing to divide the twisted pairs of the cable, and a load bar mounted in the housing and connected to the front side of the cable organizer to accommodate the conductors of the twisted pairs of the cable individually. The housing has a holding down block suspending in a top locating slot. The holding down block is stamped into the desired shape to hold down the cable after insertion of the cable with the cable organizer and the load bar, preventing change of the pitch of the twisted pairs of the cable.

According to another aspect of the present invention, the cable organizer has a longitudinally extending top guide groove for receiving the fourth and fifth conductor of the cable, a longitudinally extending bottom guide groove for receiving the third and sixth conductors of the cable, a longitudinally extending left guide groove for receiving the seventh and eighth conductors of the cable, a longitudinally extending right guide groove for receiving the first and second conductors of the cable, a horizontal partition wall that divides the top guide groove and the bottom guide groove and has two extension portions respectively extended from two opposite lateral sides thereof to divide the left guide groove and the right guide groove from the top guide groove and the bottom guide groove.

According to still another aspect of the present invention, the cable organizer has two guide flanges respectively protruded from a front wall thereof around the left guide groove and the right guide groove for engaging into the guide grooves in the rear open chamber of the load bar so that the cable can conveniently and quickly be inserted with the cable organizer and the load bar into the housing for enabling the hold down block of the housing to be driven into the engagement position to hold down the cable so as to complete the installation.

According 6to still another aspect of the present invention, the rear open chamber of the load bar is a tapered chamber, having a top side, a bottom side opposite to the top side, and 8 wire grooves sloping in one direction on each of top and bottom sides in communication with the wire slots of the load bar for guiding the conductors of the cable into the wire slots of the load bar respectively

DETAILED DESCRIPTION OF THE INVENTION

Figure 2:
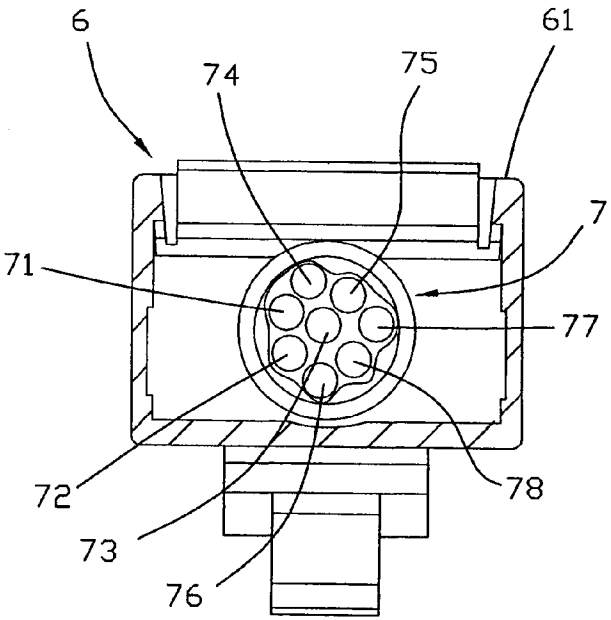
Fig. 2 PRIOR ART
FIG. 2 is a cross sectional view of FIG. 1.
Figure 1:
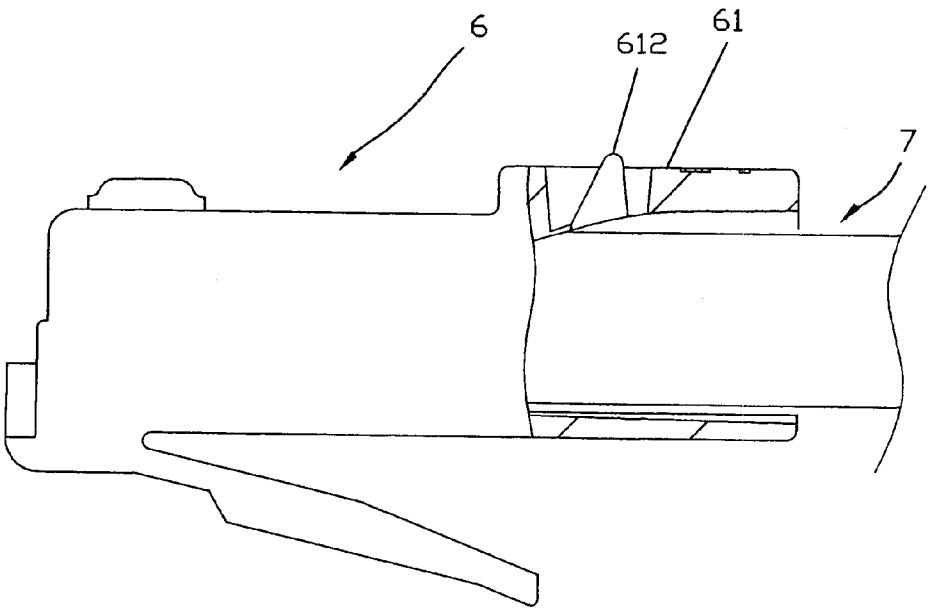
Fig. 1 PRIOR ART
FIG. 1 is a schematic view, partially in section, of a modular plug according to the prior art before stamp of the holding down block of the housing.
Figure 4:
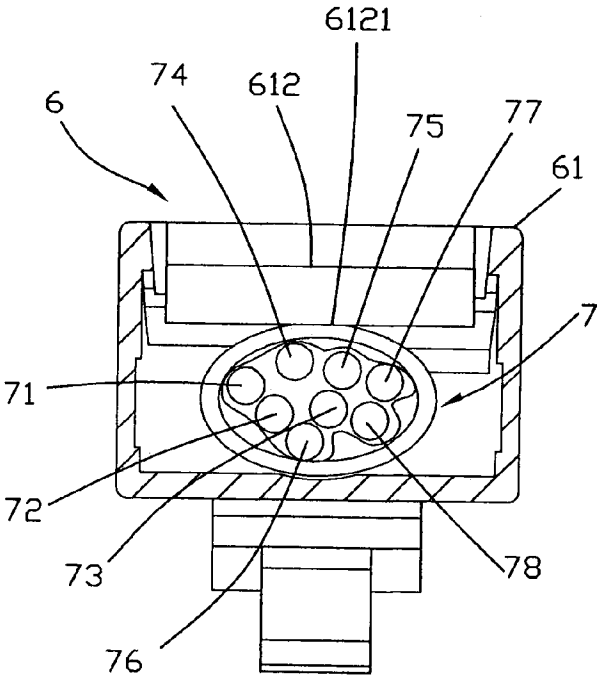
Fig. 4 PRIOR ART
FIG. 4 is a cross sectional view of FIG. 3.
Figure 3:
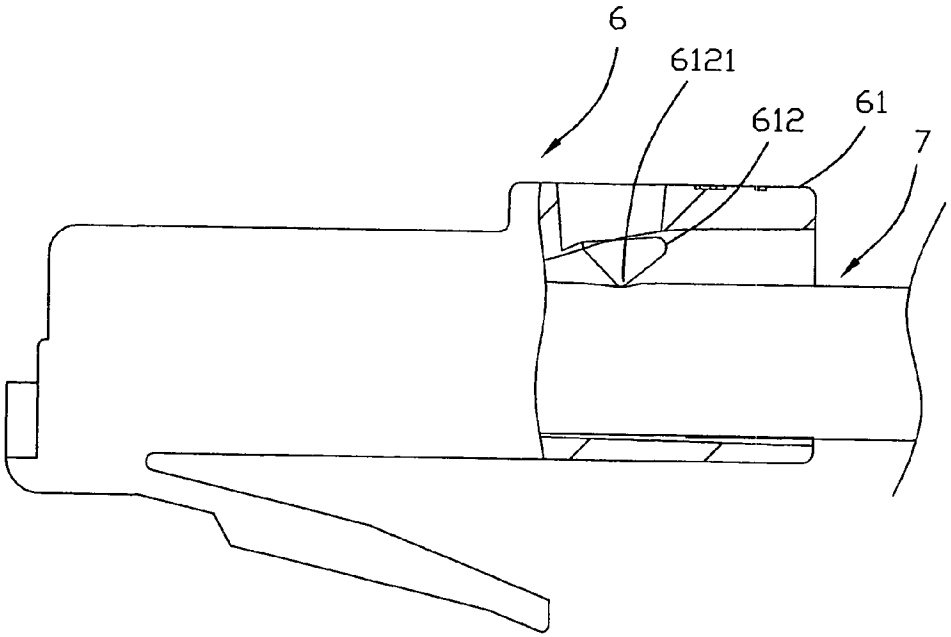
Fig. 3 PRIOR ART
FIG. 3 corresponds to FIG. 1, showing the status of the plug after stamp of the holding down block of the housing.

Referring to FIGS. 5~14, a plug for the transmission of high frequency/communication signals in accordance with the present invention is shown comprised of a housing 1, a load bar 2, and a cable organizer 3.

The housing 1 is molded from plastics, having a rear opening 11, a rear cable chamber 113 forwardly extending from the rear opening 11 (see FIG. 11), a front load bar chamber 111 for accommodating the load bar 2, an intermediate cable organizer chamber 112 connected between the rear cable chamber 113 and the front load bar chamber 111 for accommodating the cable organizer 3, a locating slot 12 transversely formed in the top wall thereof in communication with the rear cable chamber 113, a holding down block 121 suspending in the locating slot 12 (see FIG. 12), and 8 wire slots 10 cut through the top wall in communication with the front load bar chamber 111 and arranged in parallel for the insertion of a respective metal contacts 5. The holding down block 121 has a bottom edge 1210 that touches the periphery of the cable 4 that is inserted through the rear opening 11 into the housing 1, and a smoothly arched top recessed portion 1211 against which a hand tool or automatic stamping machine is operated to force the holding down block 121 into position to hold down the cable 4 (see FIGS. 13 and 14), preventing a change of the pitch of the twisted pairs 41,42; 43,46; 47,48 and ensuring normal signal transmission of the cable. Further, the front load bar chamber 111 has a rectangular front part 1111 and a backwardly expanded and tapered rear part 1112. The intermediate cable organizer chamber 112 is directly connected to the tapered rear part 1112, having a profile corresponding to the contour of the load bar 2.

The load bar 2 has 8 wire slots 20 longitudinally formed in the front side and arranged in parallel, and a rear open chamber 21 in the tapered rear part (see FIG. 6) in communication with the wire slots 20. The wire slots 20 each have the respective top side opened. The conductors 41, 42, 43, 44, 45, 46, 47, 48 are inserted through the rear open chamber 21 into the wire slots 20 respectively. The load bar 2 further has two guide grooves 211 and 212 formed in the rear open chamber 21 at two opposite lateral sides.

The cable organizer 3 has a longitudinally extending top guide groove 31, a longitudinally extending bottom guide groove 32, a longitudinally extending left guide groove 33, a longitudinally extending right guide groove 34, a horizontal partition wall 35 that divides the top guide groove 31 and the bottom guide groove 32 (see FIG. 6), and two guide flanges 333 and 343 respectively protruded from the front wall thereof around the left guide groove 33 and the right guide groove 34. The horizontal partition wall 35 has two extension portions 351 and 352 respectively extended from two opposite lateral sides thereof and separating the left guide groove 33 and the right guide groove 34. The bottom guide groove 32 has a width gradually reducing from the front side toward the rear side (see FIGS. 6 and 7). The left guide groove 33 and the right guide groove 34 slope downwards from the rear side toward the front side, each having a front end terminating in a tapered guide surface portion 331 or 341 and a narrow groove section 332 or 342. During installation of the plug, the guide flanges 333 and 343 of the cable organizer 3 are respectively inserted into the guide grooves 211 and 212 in the rear open chamber 21 of the load bar 2, allowing insertion of the fourth conductor 44 and fifth conductor 45 of the cable 4 into the top guide groove 31, the third conductor 43 and sixth conductor 46 of the cable 4 into the bottom guide groove 32, the first conductor 41 and second conductor 42 into the right guide groove 34, and the seventh conductor 47 and eighth conductor 48 into the left guide groove 33.

Figure 5:
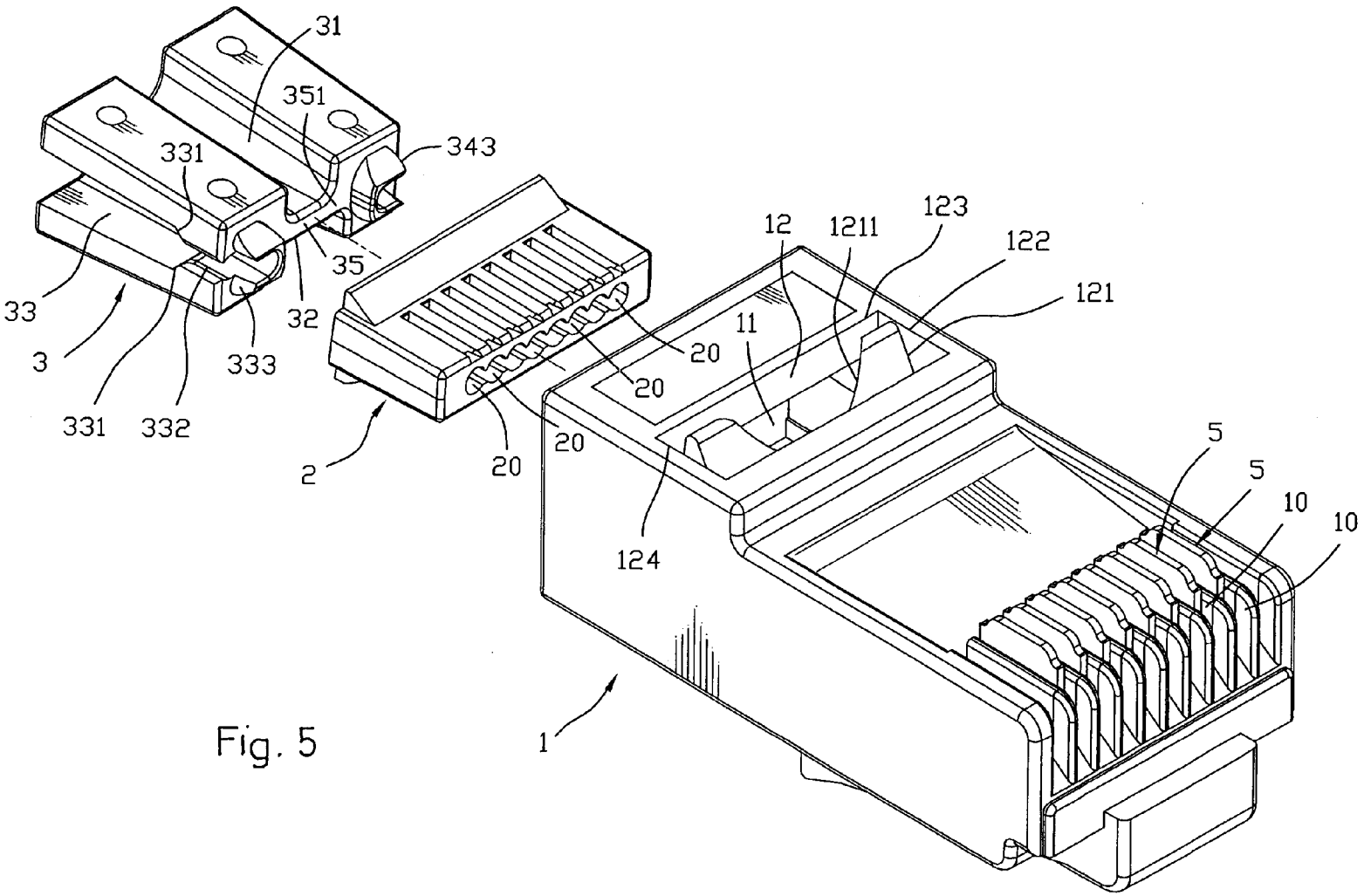
FIG. 5 is an exploded view of a plug for the transmission of high frequency/communication signals according to the present invention.
Figure 12:
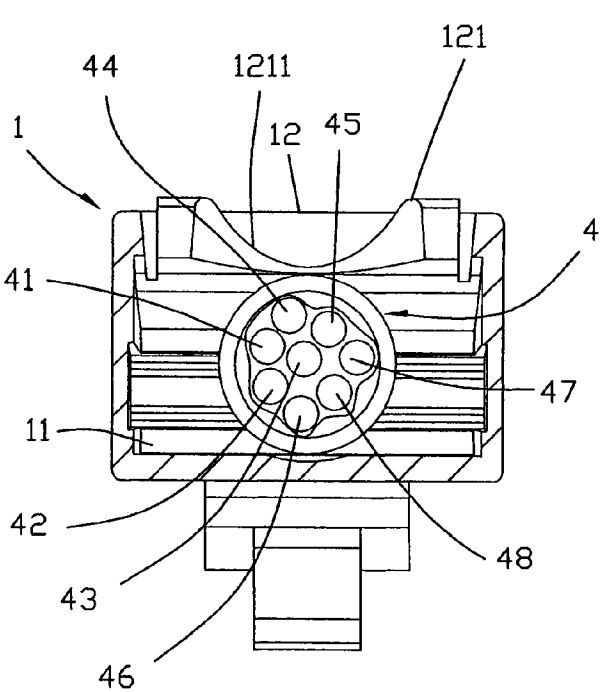
FIG. 12 is a cross sectional view of FIG. 10.
Figure 11:
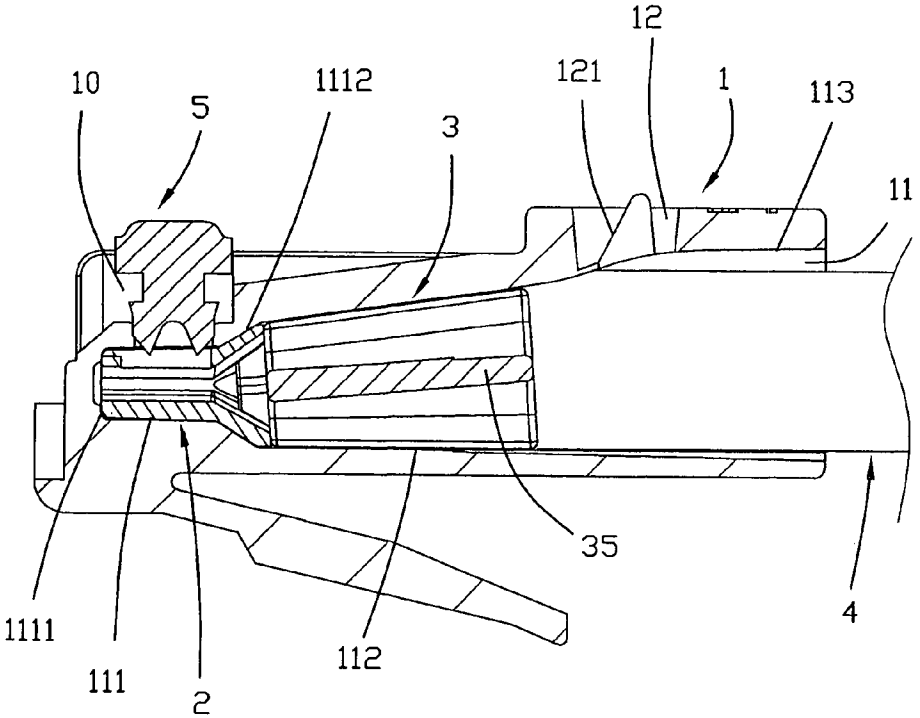
FIG. 11 is a longitudinal view in section of FIG. 10.
Figure 14:
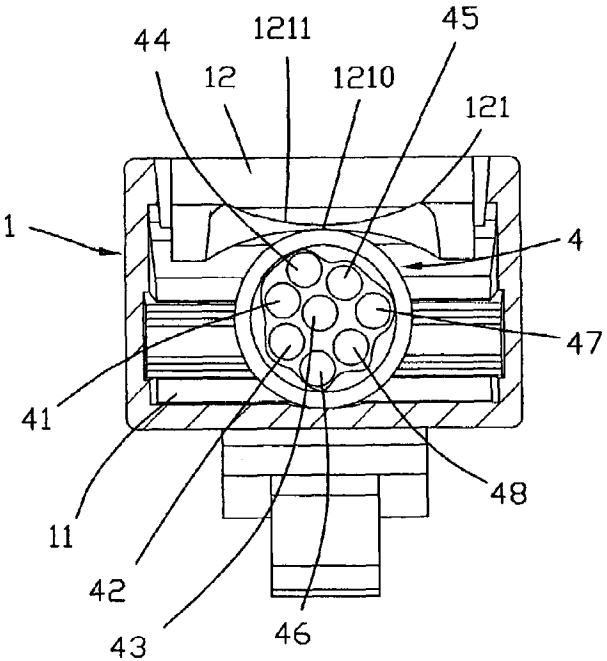
FIG. 14 is similar to FIG. 12 but showing the holding down block driven into the engagement position.
Figure 13:
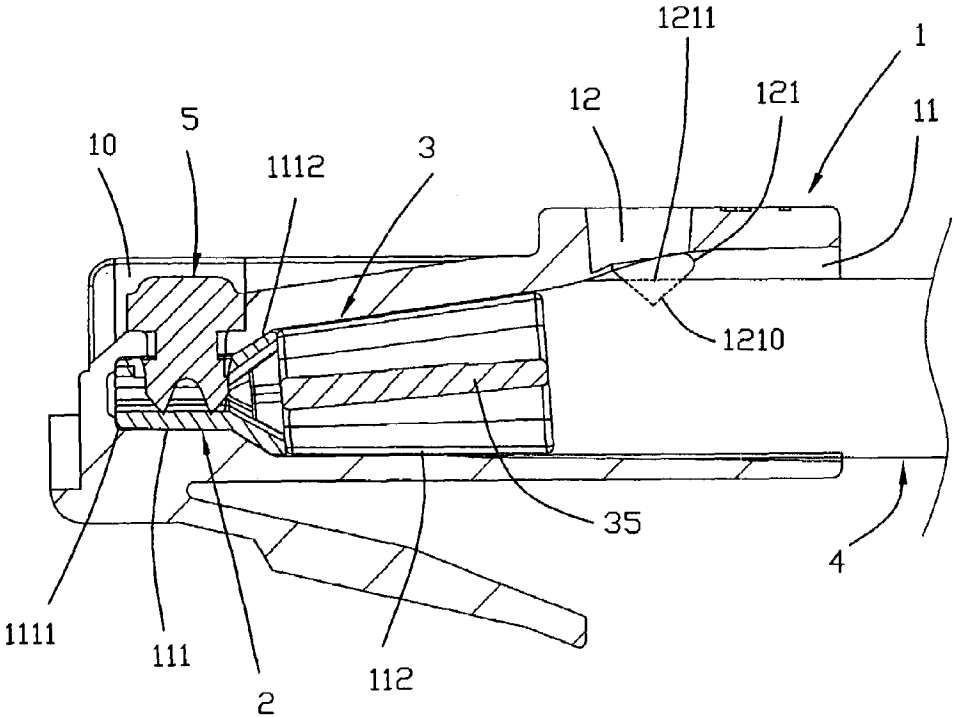
FIG. 13 is similar to FIG. 11 but showing the holding down block driven into the engagement position.

Referring to FIGS. 5, 11 and 12, the holding down block 121 is formed integral with one of the four peripheral sidewalls of the locating slot 12 and suspending in the locating slot 12, and spaced from the other three peripheral sidewalls 122,123,124 of the locating slot 12 at a distance so that the holding down block 121 can conveniently be stamped.

Figure 6:
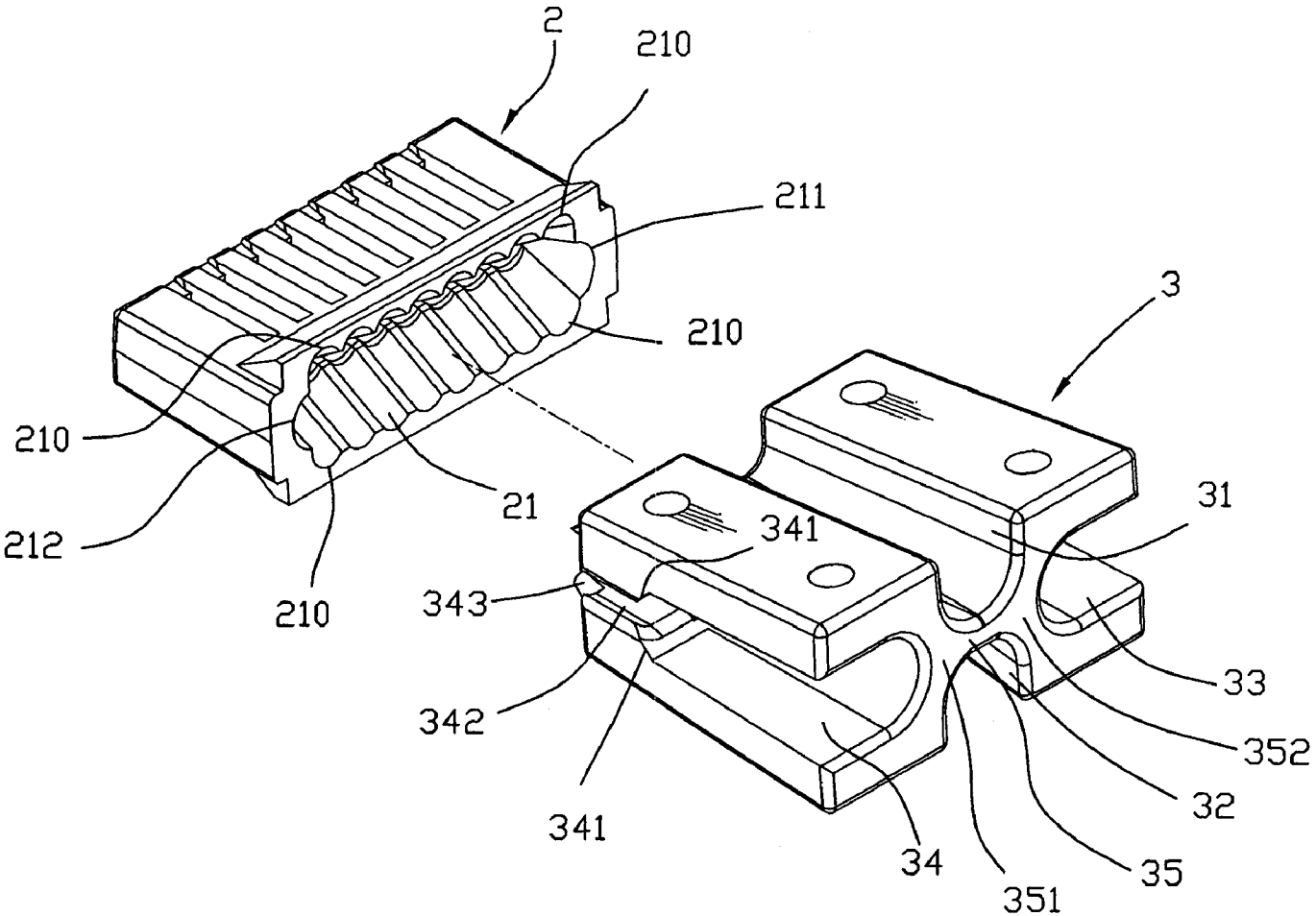
FIG. 6 is an exploded view of a part of the present invention, showing the relationship between the load bar and the cable organizer.
Figure 7:
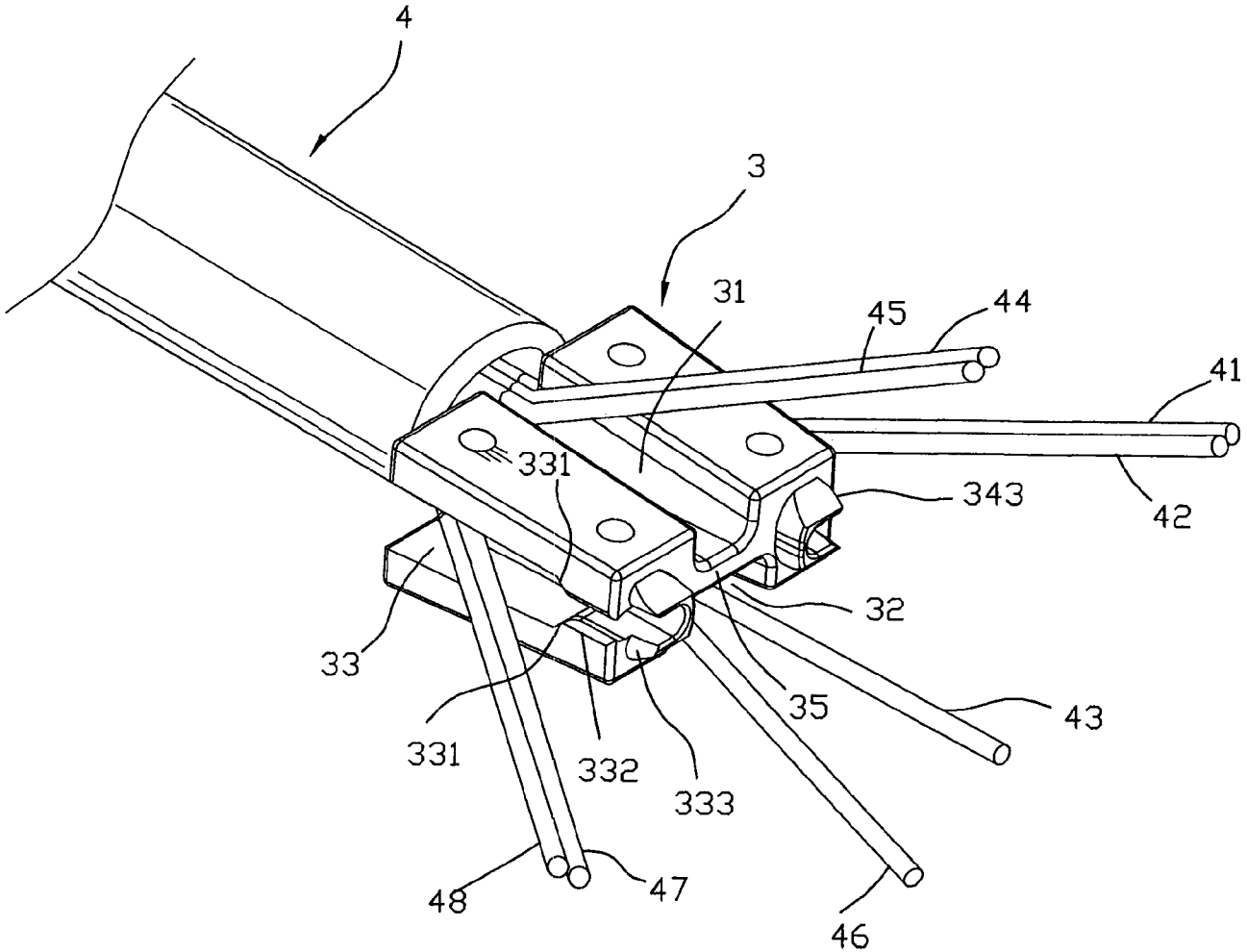
FIG. 7 is a schematic elevational view showing the twisted pairs of the cable divided by the cable organizer according to the present invention.
Figure 8:
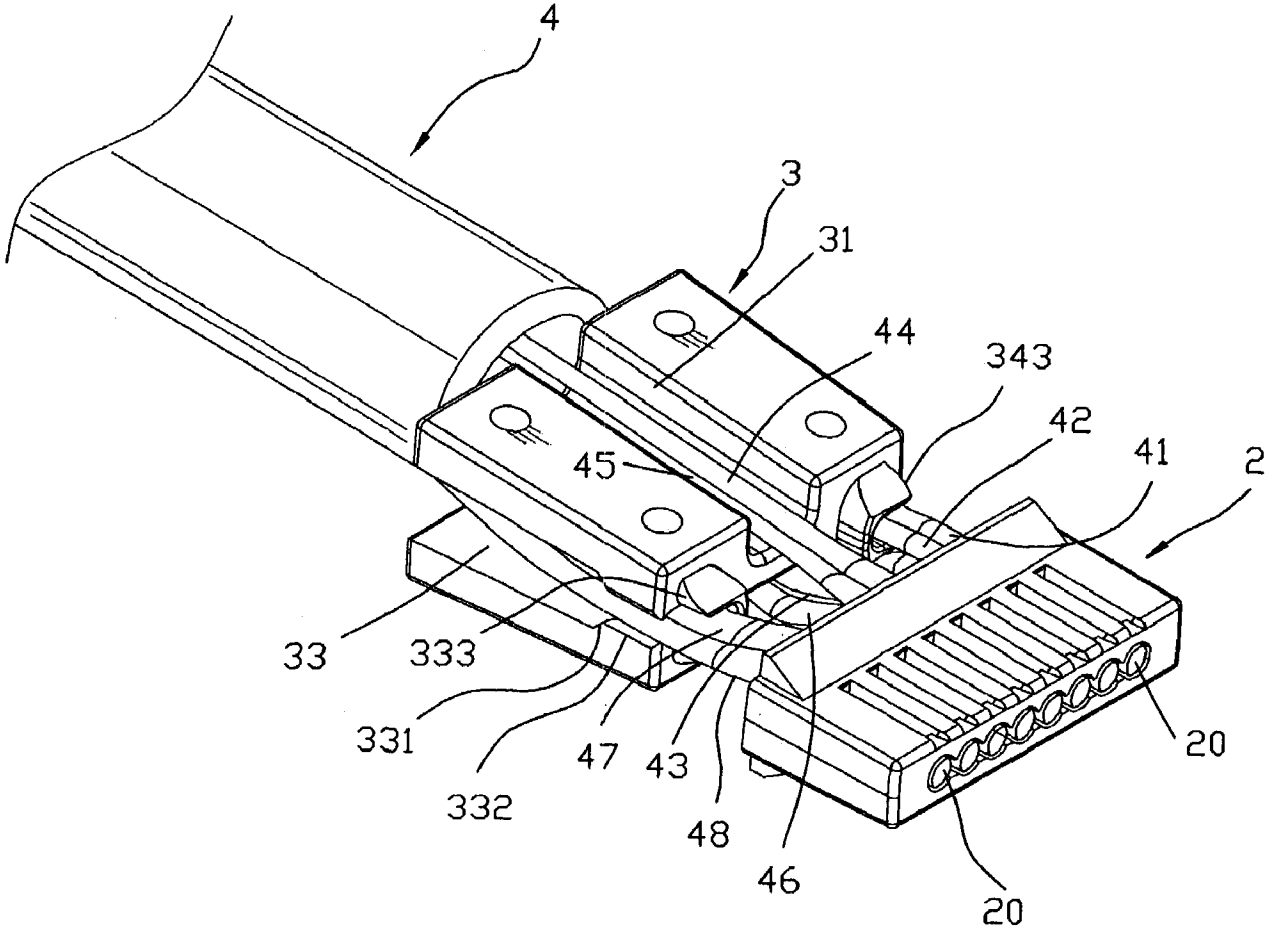
FIG. 8 illustrates the twisted pairs of the cable inserted through the cable organizer into the load board according to the present invention before connection of the load bar to the cable organizer.
Figure 9:
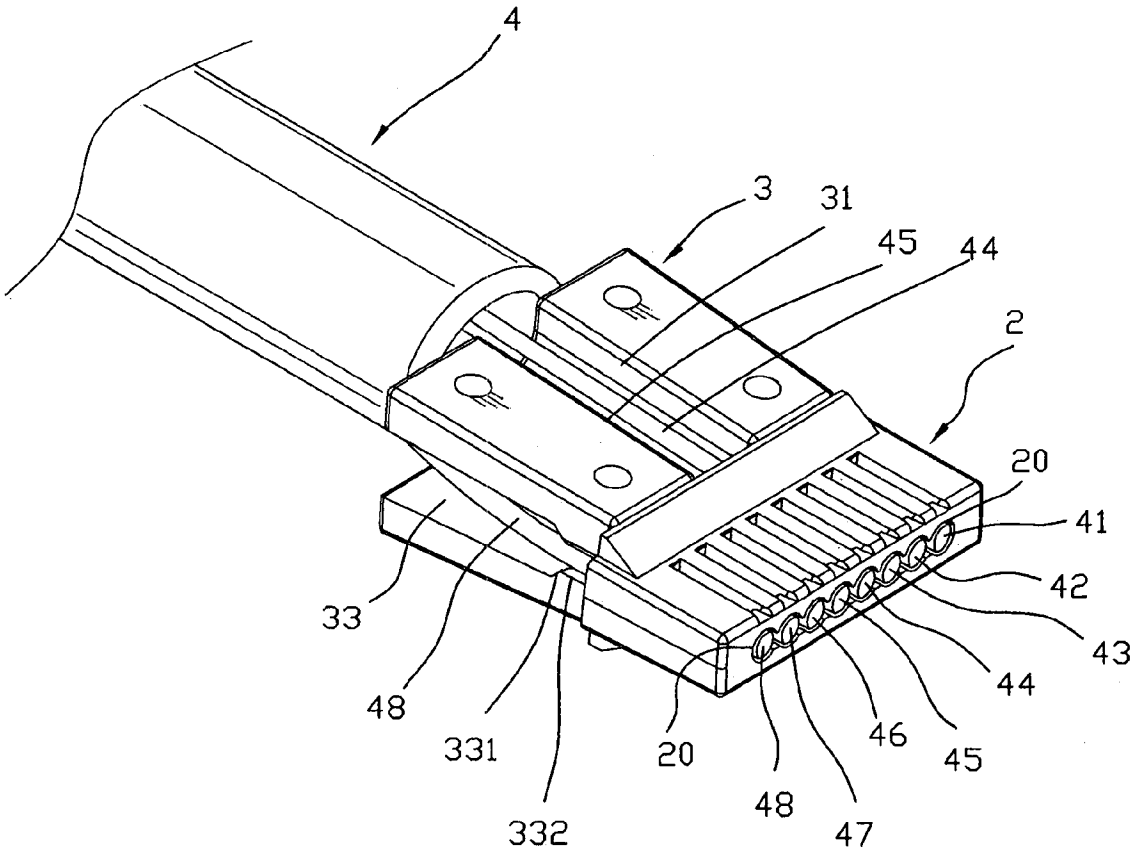
FIG. 9 is similar to FIG. 8 but showing the load bar fastened to the cable organizer.
Figure 10:
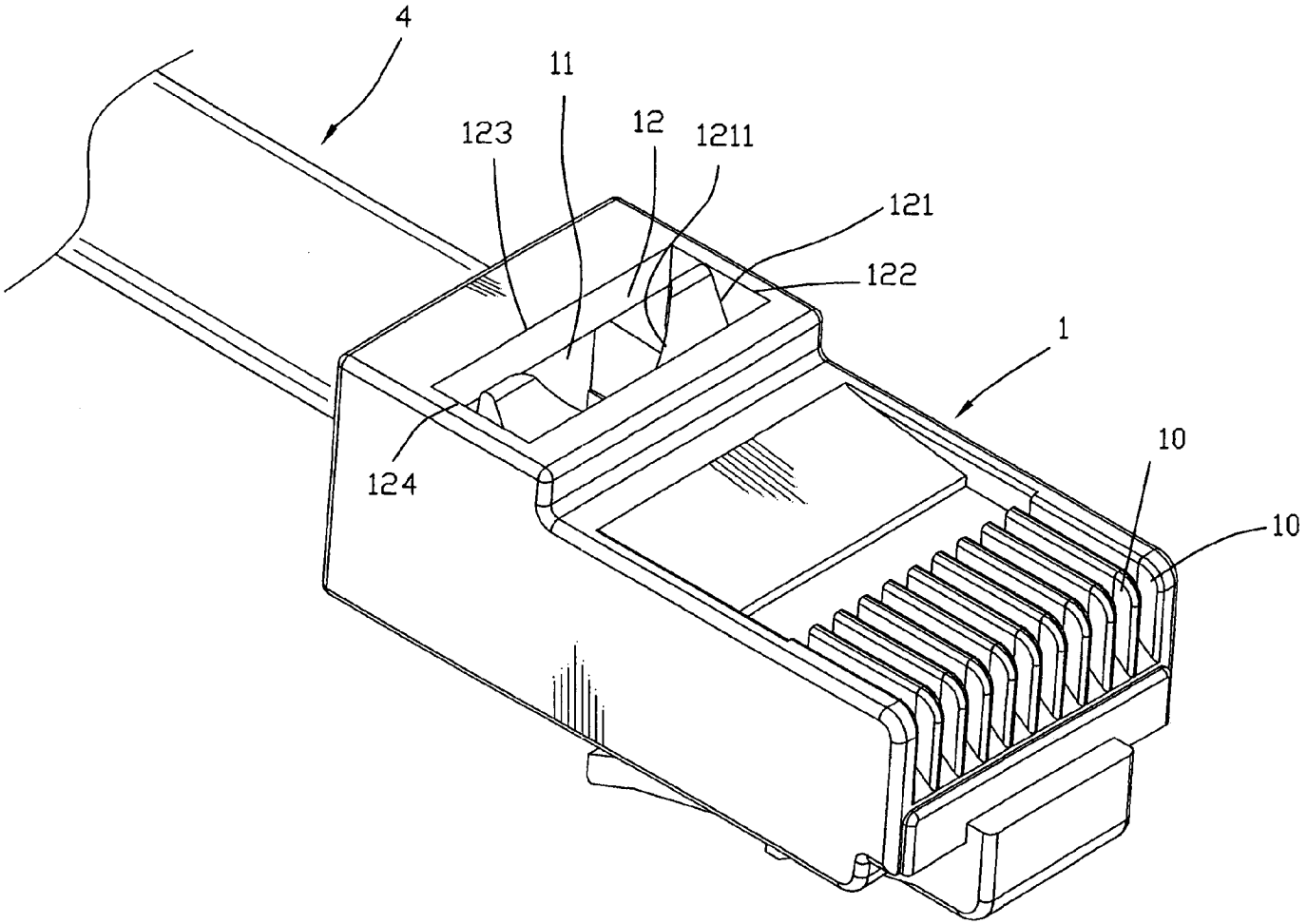
FIG. 10 illustrates the cable organizer and the load bar inserted with the cable into the housing according to the present invention.

Referring to FIG. 6, the rear open chamber 21 of the load bar 2 is a tapered chamber, having 8 wire grooves 210 sloping in one direction and symmetrically formed in each of the top and bottom sides in communication with the wire slots 20 respectively. By means of the wire grooves 210, the 8 conductors 41, 42, 43, 44, 45, 46, 47, 48 of the cable 4 are smoothly and accurately guided into the respective wire slots 20.

Based on the aforesaid structure, the first conductor 41 and second conductor 42 of the cable 4 are inserted through the right guide groove 34 of the cable organizer 3, the seventh conductor 47 and eighth conductor 48 of the cable 4 are inserted through the left guide groove 33 of the cable organizer 3, the fourth conductor 44 and fifth conductor 45 of the cable 4 are inserted through the top guide groove 31 of the cable organizer 3, and the third conductor 43 and sixth conductor 46 of the cable 4 are inserted through the bottom guide groove 32 of the cable organizer 3. Thereafter, the 8 conductors 41, 42, 43, 44, 45, 46, 47, 48 of the cable 4 are respectively guided by the wire grooves 210 of the load bar 2 into the respective wire slots 20, and then the guide flanges 333 and 343 of the cable organizer 3 are respectively inserted into the guide grooves 211 and 212 in the rear open chamber 21 of the load bar 2 (see FIG. 6), and then the load bar 2 with the cable organizer 3 and the cable 4 are inserted through the rear opening 11 into the inside of the housing 1, keeping the load bar 2 and the cable organizer 3 respectively accommodated in the front load bar chamber 111 and the intermediate cable organizer chamber 112. Thereafter, the prepared 8 metal contacts 5 are respectively inserted into the wire slots 10 from the top side and forced to make a respective electric contact with the conductors 41, 42, 43, 44, 45, 46, 47, 48 of the cable 4 respectively, and then the holding down block 121 of the housing 1 is stamped into position to force the bottom edge 1210 into engagement with the periphery of the cable 4, thereby affix the cable 4 to the housing 1. Because the third and sixth conductors 43 and 46, the fourth and fifth conductors 44 and 45, the first and second conductors 41 and 42, and the seventh and eighth conductors 47 and 48 are respectively separated by the horizontal partition wall 35 and the extension portions 351 and 352 of the horizontal partition wall 35, the invention greatly reduces crosstalk noises, and prevents return loss and insertion loss.

Further, the load bar 2 can be molded from plastics or metal powder plastic material.

As described above, the invention provides a plug for the transmission of high frequency/communication signals that has the benefits as follows:

1. The housing 1 has a holding down block 121 protruded from one sidewall of the locating slot 12. The holding down block 121 has a smoothly arched top recessed portion 1211 against which a tool is driven to force the holding down block 121 into the desired position to hold down the cable 4, maintaining the pitch among the twisted pairs 44,45; 43,46; 41,42; 47,48 and normal signal transmission function of the cable 4.

2. Because the third and sixth conductors 43 and 46, the fourth and fifth conductors 44 and 45, the first and second conductors 41 and 42, and the seventh and eighth conductors 47 and 48 are respectively separated by the horizontal partition wall 35 and the extension portions 351 and 352 of the horizontal partition wall 35, the invention greatly reduces crosstalk noises, and prevents return loss and insertion loss.

3. After insertion of the conductors 41, 42, 43, 44, 45, 46, 47, 48 of the cable 4 through the cable organizer 3 and the load bar 2, the cable organizer 3 is connected to the load bar 2 by inserting the guide flanges 333 and 343 of the cable organizer 3 into the guide grooves 211 and 212 in the rear open chamber 21 of the load bar 2, and then the load board 2 with the cable organizer 3 and the cable 4 are inserted through the rear opening 11 into the inside of the housing 1 to have the load bar 2 and the cable organizer 3 be respectively accommodated in the front load bar chamber 111 and the intermediate cable organizer chamber 112, and then the holding down block 121 of the housing 1 is stamped into the engagement position to hold down the cable 4, thereby completing the installation.

4. The load bar 2 has sloping wire grooves 210 on the top and bottom walls inside the rear open chamber 21 for guiding the conductors 41, 42, 43, 44, 45, 46, 47, 48 of the cable 4 into the respective wire slots 20 so that the conductors 41, 42, 43, 44, 45, 46, 47, 48 of the cable 4 can easily and accurately be inserted into the respective wire slots 20.

Although a particular embodiment of the invention has been described in detail for purposes of illustration, various modifications and enhancements may be made without departing from the spirit and scope of the invention. Accordingly, the invention is not to be limited except as by the appended claims

What is claimed is:

1. A plug fastened to a cable and electrically connected to the conductors of 4 twisted pairs of the cable, the plug comprising:

a housing molded from plastics, said housing having a rear opening, a rear cable chamber forwardly extending from said rear opening, a front load bar chamber, an intermediate cable organizer chamber connected between said rear cable chamber and said front load bar chamber, a locating slot transversely formed in a top wall thereof in communication with said rear cable chamber, a holding down block suspending in said locating slot and adapted to hold down said cable, and 8 wire slots cut through the top wall in communication with said front load bar chamber and arranged in parallel, 8 metal contacts respectively mounted in the wire slots of said housing and forced to make a respective electric contact with the conductors of said cable respectively, said holding down block having a bottom edge for engaging the periphery of said cable, and a smoothly arched top recessed portion for receiving tool means used to force said holding down block into engagement with the periphery of said cable;

a load bar accommodated in said front load bar chamber of said housing, said load bar having 8 wire slots longitudinally formed in a front side and arranged in parallel for receiving the conductors of said cable respectively, a rear open chamber formed in a tapered rear part thereof in communication with the wire slots of said load bar, the wire slots of said load bar each having a top open side, and two guide grooves formed in said rear open chamber at two opposite lateral sides; and a cable organizer accommodated in said intermediate cable organizer chamber of said housing, said cable organizer having a front side, a rear side, a longitudinally extending top guide groove for receiving the fourth and fifth conductor of said cable, a longitudinally extending bottom guide groove for receiving the third and sixth conductors of said cable, a longitudinally extending left guide groove for receiving the seventh and eighth conductors of said cable, a longitudinally extending right guide groove for receiving the first and second conductors of said cable, a horizontal partition wall that divides said top guide groove and said bottom guide groove, and two guide flanges respectively protruded from a front wall thereof around said left guide groove and said right guide groove and respectively engaged into the guide grooves in the rear open chamber of said load bar, said horizontal partition wall having two extension portions respectively extended from two opposite lateral sides thereof to divide said left guide groove and said right guide groove from said top guide groove and said bottom guide groove, said bottom guide groove having a width gradually reducing from the front side of said cable organizer toward the rear side of said cable organizer, said left guide groove and said right guide groove sloping downwards from the rear side of said cable organizer toward the front side of said cable organizer and each having a front end terminating in a tapered guide surface portion and a narrow groove section.

2. The plug as claimed in claim 1, wherein said locating slot of said housing is a rectangular slot having four peripheral sidewalls; said holding down block extends from one peripheral sidewall of said locating slot and suspending in said locating slot and spaced from the other three peripheral sidewalls of said locating slot at a distance.

3. The plug as claimed in claim 1, wherein the rear open chamber of said load bar is a tapered chamber, having a top side, a bottom side opposite to the top side, and 8 wire grooves sloping in one direction on each of top and bottom sides in communication with the wire slots of said load bar for guiding the conductors of said cable into the wire slots of said load bar respectively.

* * * * *